US008650901B2

(12) United States Patent
Gottschling et al.

(10) Patent No.: US 8,650,901 B2
(45) Date of Patent: Feb. 18, 2014

(54) TRAY AS WELL AS REFRIGERATOR UNIT AND/OR FREEZER UNIT HAVING AT LEAST ONE TRAY

(75) Inventors: Rudolf Gottschling, Bad Wurzach/Arnach (DE); Volker Friedmann, Biberach (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 1007 days.

(21) Appl. No.: 12/666,851

(22) PCT Filed: Jun. 26, 2008

(86) PCT No.: PCT/EP2008/005231

§ 371 (c)(1),
(2), (4) Date: Dec. 28, 2009

(87) PCT Pub. No.: WO2009/000540

PCT Pub. Date: Dec. 31, 2008

(65) Prior Publication Data

US 2010/0180624 A1 Jul. 22, 2010

(30) Foreign Application Priority Data

Jun. 28, 2007 (DE) ..... 20 2007 009 035 U
Mar. 19, 2008 (DE) ..... 20 2008 003 856 U

(51) Int. Cl.
*F25C 1/00* (2006.01)

(52) U.S. Cl.
USPC ..... 62/353

(58) Field of Classification Search
USPC ..... 62/347, 353, 459, 345
See application file for complete search history.

(56) References Cited

U.S. PATENT DOCUMENTS

| | | | | |
|---|---|---|---|---|
| 2,450,844 | A | | 10/1948 | Stuart |
| 2,657,894 | A | | 11/1953 | Sklenar |
| 2,907,179 | A | * | 10/1959 | Frei ..... 62/135 |
| 3,883,204 | A | | 5/1975 | Prada et al. |
| 5,749,241 | A | | 5/1998 | Ryu et al. |
| 5,893,620 | A | | 4/1999 | Birgelis |
| 6,708,509 | B1 | | 3/2004 | Senner |

FOREIGN PATENT DOCUMENTS

| | | | |
|---|---|---|---|
| CN | 1119265 | A | 3/1996 |
| DE | 8909401 | | 9/1989 |
| DE | 4113767 | | 10/1991 |
| DE | 4418873 | A1 | 12/1995 |
| DE | 19840415 | | 3/2000 |
| DE | 202004016966 | | 3/2006 |
| DE | 102005045326 | | 3/2007 |
| EP | 1657510 | | 5/2006 |
| JP | 10-220944 | | 8/1998 |
| WO | 02/081985 | | 10/2002 |
| WO | 2006/106050 | | 10/2006 |

* cited by examiner

*Primary Examiner* — Melvin Jones
(74) *Attorney, Agent, or Firm* — Dilworth & Barrese, LLP

(57) ABSTRACT

The present invention relates to a tray having an icemaker as well as having a holder to fix the icemaker to the tray.

28 Claims, 4 Drawing Sheets

TRAY AS WELL AS REFRIGERATOR UNIT AND/OR FREEZER UNIT HAVING AT LEAST ONE TRAY

BACKGROUND OF THE INVENTION

The present invention relates to a tray as well as to a refrigerator unit and/or a freezer unit having one or more such trays.

Freezer units are known from the prior art which have so-called icemakers, with the icemakers frequently being attached to the lower side of the unit top. Such a positioning of the icemaker admittedly generally ensures a good accessibility of the icemaker; however, it is comparatively inflexible since the positioning of the icemaker cannot be selected, but is rather largely preset.

SUMMARY OF THE INVENTION

It is the object of the present invention to provide a refrigerator unit and/or a freezer unit by means of which the icemaker can be fixed in the unit.

This object is solved by a tray as well as by a refrigerator unit and/or freezer unit having the features herein.

Provision is made in accordance with the invention that the tray is provided with an icemaker, with a holder being provided to fix the icemaker to the tray. Provision is preferably made that the holder is made such that it engages around the tray on its rear side and fixes the tray at its position spaced apart from the rear side of the tray by means of an adhesive connection, a rivet connection, a weld connection, a shape matched connection or by means of a screw connection which is formed by a holding part which can be pushed on. The weld connection can, for example, be a connection by means of ultrasonic welding or friction welding.

Provision can, for example, be made that the icemaker is connected to the tray in the front region thereof by a screw connection. The holder is made in accordance with the invention at the rear side of the tray such that it engages around the tray, which is possible, for example, by one or more lugs which extend over the upper side of the tray and which, for example, bound a groove-shaped recess for the reception of the tray.

Provision is made in a preferred embodiment of the invention that the holder includes a holding part which engages around a part of the icemaker. This holding part can, for example, be pushed onto the tray and onto the icemaker at the front side and clamps the icemaker and the tray together. It is conceivable to fix the holding part to the icemaker by means of a latch connection.

Provision is made in a further preferred embodiment of the invention that a reed contact for tray polling is arranged in the holding part. The reed contact preferably has a plug connection by means of which the reed contact can be connected to an electronics board or to a control or the like. The plug connection does not have to be arranged directly at the reed contact in this respect. It is also conceivable that there is a connection cable between the reed contact and the electronics board which is made with a releasable plug connection.

Provision is made in a further embodiment of the invention that the holder is made such that the icemaker is arranged directly below the tray. Such an embodiment is space-saving and has the advantage that an ice tray disposed thereunder can be made correspondingly larger.

Provision is made in a further embodiment of the invention that the tray is made with a cut-out on its rear side for the reception of the water inflow. Provision is preferably made that the cut-out has a rounded edge and is preferably made as a semicircular or part-circular portion in the rear region of the tray.

The tray can have a cut-out, e.g. in the form of a groove, a hole, etc. for the reception of the holder such as a screw.

The tray can be made as a glass tray. However, other materials can also be used.

The invention further relates to a refrigerator unit and/or a freezer unit having one or more trays in accordance with the description herein.

The tray can lie directly on a support surface, in particular on a rib of the inner container. It is also conceivable that one or more holding rails are provided to which the tray is connected in its lateral edge regions or by means of which the tray lies on the support surface of the inner container.

Provision can furthermore be made that the unit has at least one drawer which lies directly on the tray or which can be moved in and out via extensible rails, with the extensible rails being connected to the holding rails in accordance with the description herein.

At least one securing element can furthermore be provided which is arranged such that it prevents an unauthorized removal of the tray from the unit. Such a securing arrangement can be made such that it secures the tray to the inner container by a force-transmitting connection such as a clamping connection. Provision can be made in this respect that this securing arrangement of the tray is made such that it can be inserted and removed between the tray and the holding rail in a lateral direction, from the point of view of a user standing in front of the unit.

Provision can furthermore be made that the securing element is made such that it clamps the holding rail to the inner container. Provision can be made in this respect that the securing element can be inserted from the front between the inner container and the holding rail.

Provision is made in a further embodiment of the invention that the water inflow for the icemaker runs through the rear wall of the unit so that there is no connection to the top or to the intermediate base.

Provision is made in a particularly advantageous embodiment of the invention that the tray can be removed from the unit and can be inserted at different positions in the inner space of the unit, whereby a particular flexibility is provided with respect to the position of the icemaker.

The present invention furthermore relates to a refrigerator unit and/or a freezer unit having the features herein. Provision is accordingly made that the trays are fixed by one or more securing elements such that they cannot be removed from the unit without releasing the securing elements. Provision is preferably made in this respect that the securing element or elements can only be removed with the aid of a tool.

Advantageous embodiments of the refrigerator unit form the subject matter of the description herein.

BRIEF DESCRIPTION OF THE DRAWINGS

Further advantages and details of the invention will be explained with reference to an embodiment shown in the drawing. There are shown.

DESCRIPTION OF THE PREFERRED EMBODIMENTS

Figure 1:
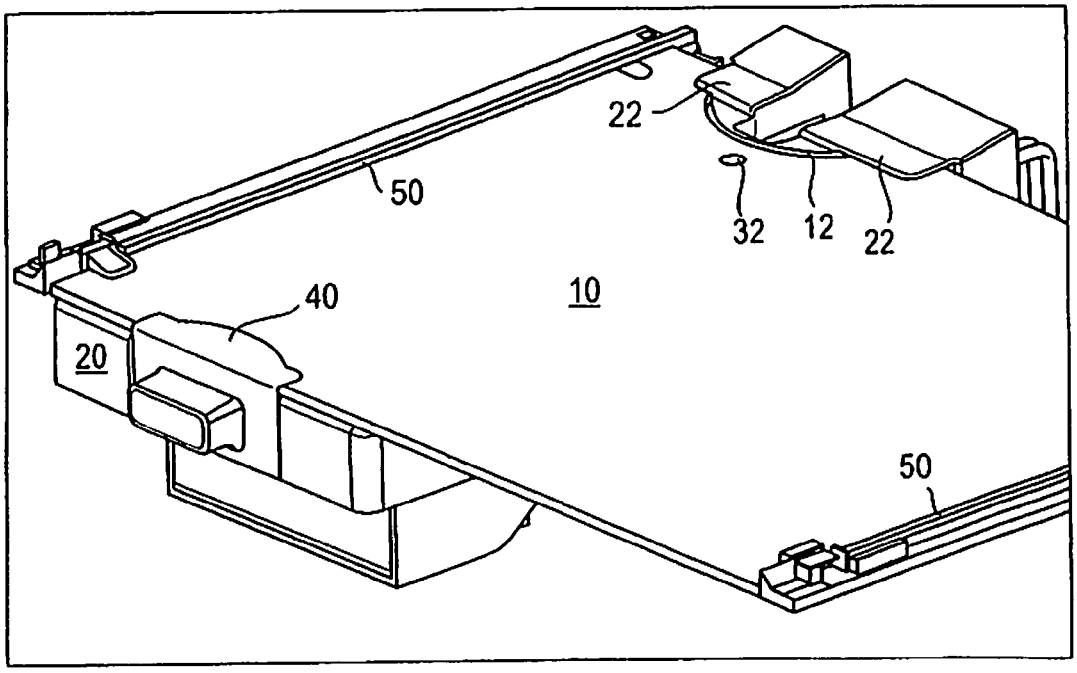
FIG. 1: the tray in accordance with the invention in a perspective representation in a first embodiment.

FIG. 1 shows the tray 10 in accordance with the present invention in a first embodiment. The tray has a throughgoing surface. In the present embodiment, it is made of glass; but the use of other materials is also conceivable. It is also possible to make the tray as a grating.

Figure 3:
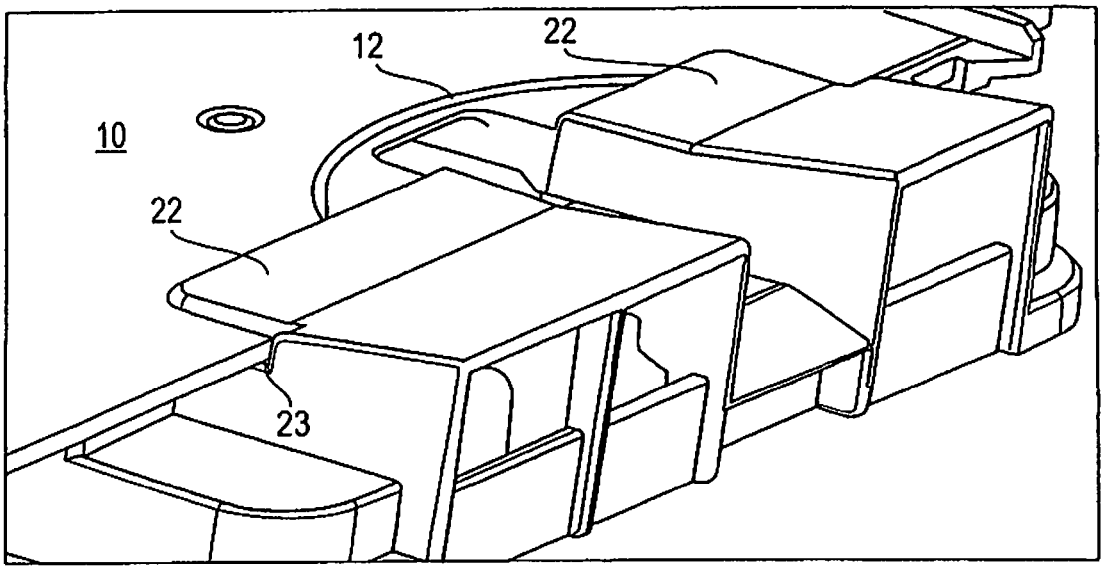
FIG. 3: the rear region of the holder engaging around the tray on its rear side.

The icemaker 20 is located directly beneath the tray 10 and is fastened to the tray 10 by means of a holder. This holder is made up in the embodiment in accordance with FIG. 1 of lugs 22 which engage around the rear side of the tray 10 and are made in one piece with the icemaker 20. As can be seen from FIG. 1 and in particular from the detailed representation in accordance with FIG. 3, the lugs 22 engage over the upper side of the tray 10. There is a groove 23 between the lugs 22 and a surface or edge of the icemaker 20 disposed beneath them and a section of the rear region of the tray 10 can be pushed into it, as can be seen, for example, from FIG. 3.

The icemaker 20 is furthermore secured in accordance with the embodiment of FIG. 1 via a holding part 40 which is made substantially in U shape in cross-section and whose limbs engage around the tray 10, on the one hand, and a part of the icemaker 20, on the other hand, as is shown, for example, in FIG. 1.

Figure 5:
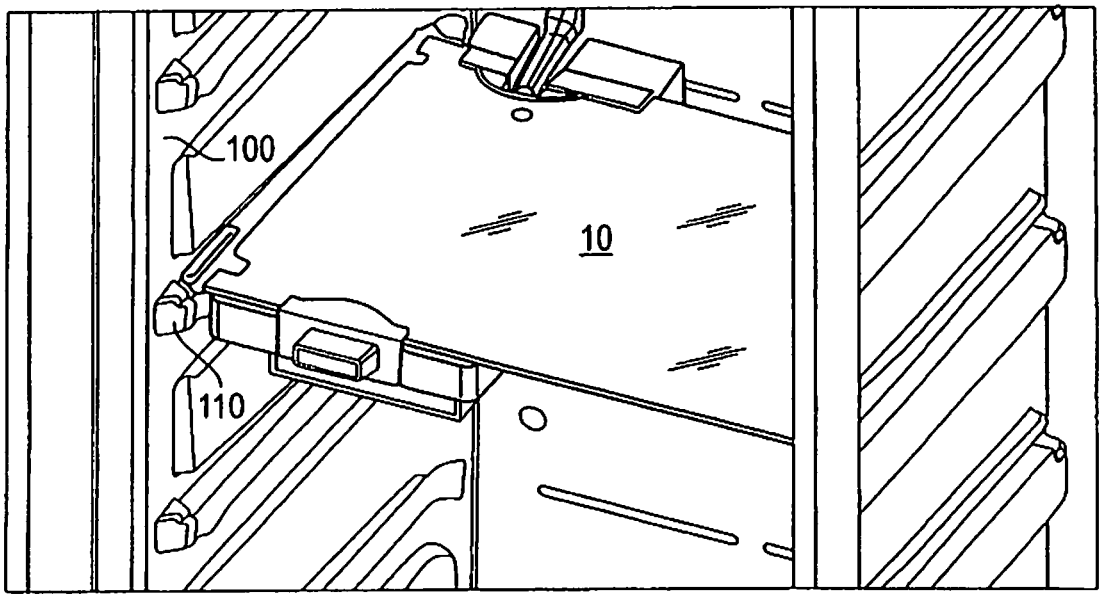
FIG. 5: a view of the refrigerator unit and/or freezer unit in accordance with the invention with an inserted tray in accordance with the invention.

As can furthermore be seen from FIG. 1, the lateral edge regions of the tray 10 are each made with a holding rail 50, said holding rails being placed onto ribs 110 of the inner container 100 of a freezer, as can be seen from FIG. 5.

Figure 2:
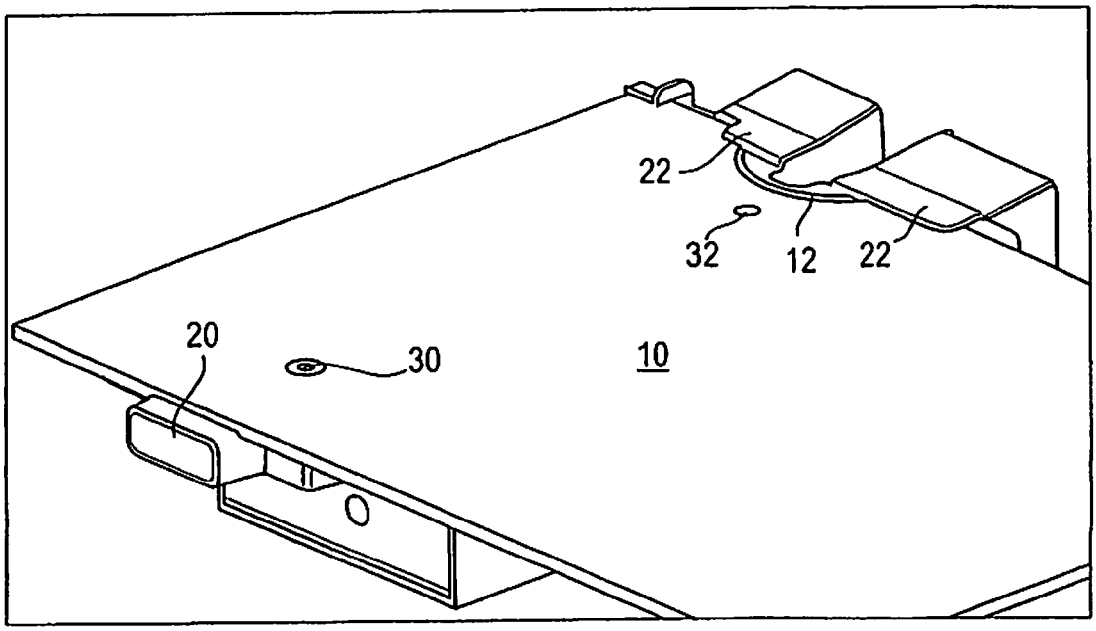
FIG. 2: the tray in accordance with the invention in a second embodiment.

FIG. 2 shows an alternative embodiment of the tray 10 in accordance with the invention. In this case, the holder is likewise made up of the lugs 22 already described with respect to FIG. 1 and furthermore of a screw connection between the tray 10 and the icemaker 20. For this purpose, a screw 30 which fixes the icemaker 20 to the tray 10 is provided in the region of the tray 10 at the front in the direction of the user. The icemaker 20 is thus also fastened to the tray 10 at a plurality of positions in this embodiment.

As can be seen from FIGS. 1 and 2, the holder is made such that the icemaker is arranged suspended beneath the tray 10 or the glass plate, with it being held and positioned without additional fastening means in the rear region. The holder is there made up of the named lugs 22 which can form an integral component of the rear region of the icemaker 20. The positioning is likewise intrinsic at the front side. The fastening of the icemaker 20 takes place here by means of a screw 30 or by means of a clamp connection via a holding part 40 which carries out a multiple function in the present embodiment, as will be explained in more detail below.

As can be seen from FIG. 1, the holding part 40 is latched at the front to the icemaker 20 and to the tray 10 such that the icemaker 20 and the tray 10 are clamped to one another. Provision is preferably made in this respect that a dismantling of the icemaker 20 or of the holding part 40 is not possible without the aid of tools.

Figure 4:
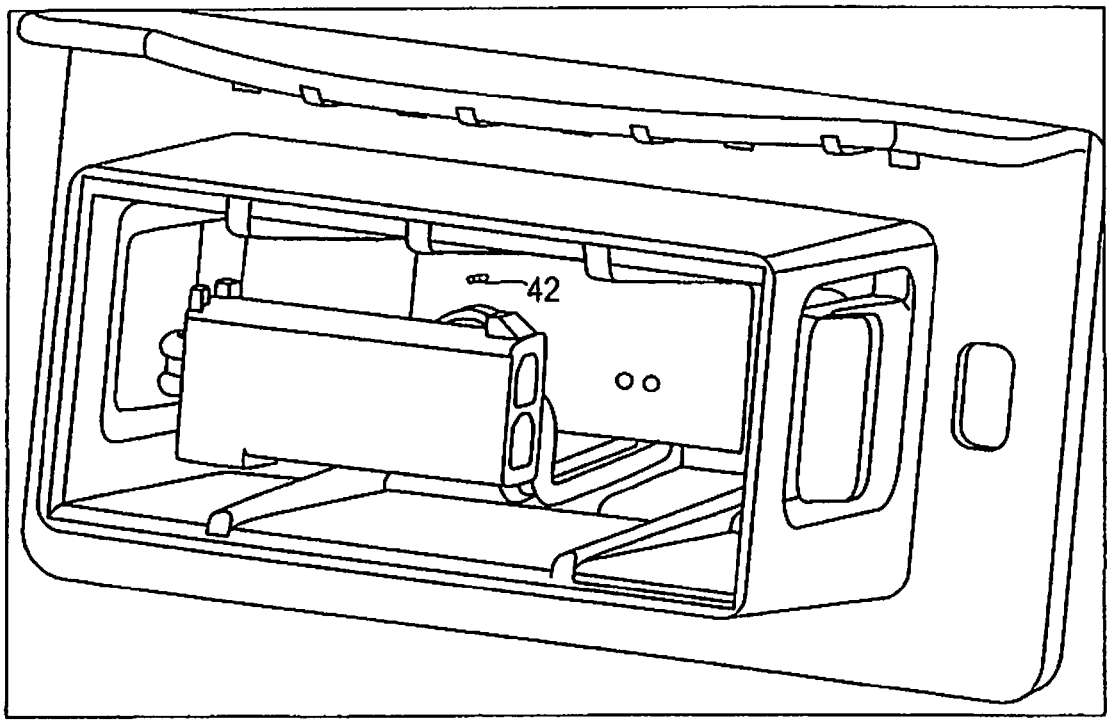
FIG. 4: a view of the holding part from the inside.

A reed contact 42 is located in the holding part 40, as can be seen from FIG. 4 which shows the holding part 40 from the inner side facing the icemaker 20. The reed contact 42 serves the drawer polling. It is known from the prior art to arrange the reed contact behind the cover in the icemaker itself. Provision is now made in accordance with this embodiment that the positioning of the reed contact 42 takes place outside the icemaker 20. The reed contact 42 communicates with an electronics board via a suitable signal line. Provision is made in this respect that the connection cable between the reed contact 42 and the electronics board is equipped with a releasable plug connection.

Such an embodiment of the invention does not only apply to the embodiment in accordance with FIG. 1, but also to that in accordance with FIG. 2. In this case, the reed contact is positioned via a similar plug connection in the front region of the icemaker 20. It can furthermore be recognized from FIG. 2 that the front region of the icemaker projects slightly over the lower side of the tray 10 so that it is also secured in a shape-matched manner by the front side of the icemaker 20.

As can be seen from FIG. 5, the tray 10 in accordance with the present invention can easily be arranged on a rib 110 of the inner container 100 of a freezer or of any other refrigerator unit and/or freezer unit. With a correspondingly variable arrangement of the water inflow, it is also possible to arrange the tray 10 at different positions in the unit. It can generally likewise be considered to arrange the icemaker 20 releasable from the tray 10 in order optionally to arrange it at another tray 10 provided that it allows the water inflow.

In any case, the icemaker position can be selected in the unit with low effort so that unit variants are optionally also possible with a different drawer division.

Figure 6:
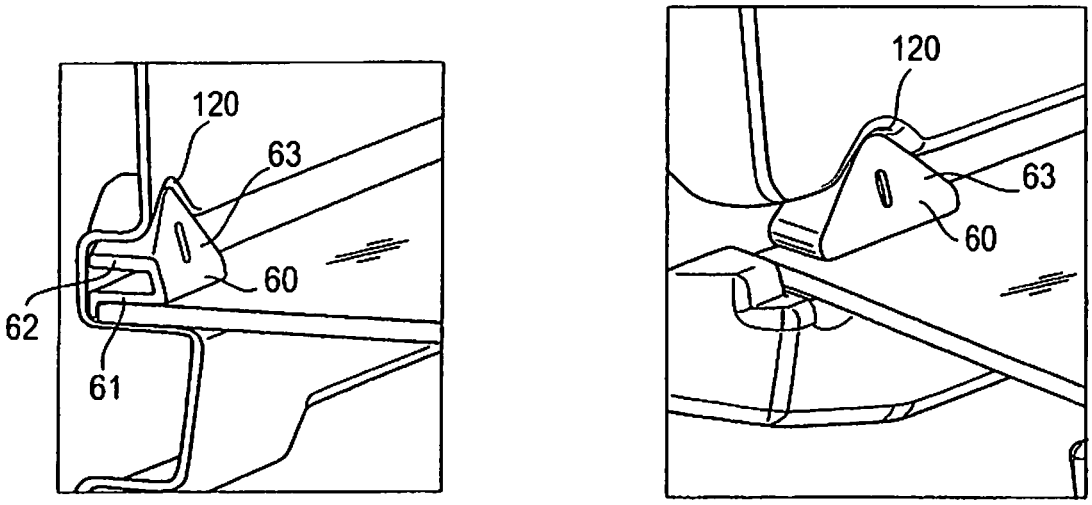
FIG. 6: different representations of a securing element for fixing the tray to the inner container.
Figure 7:
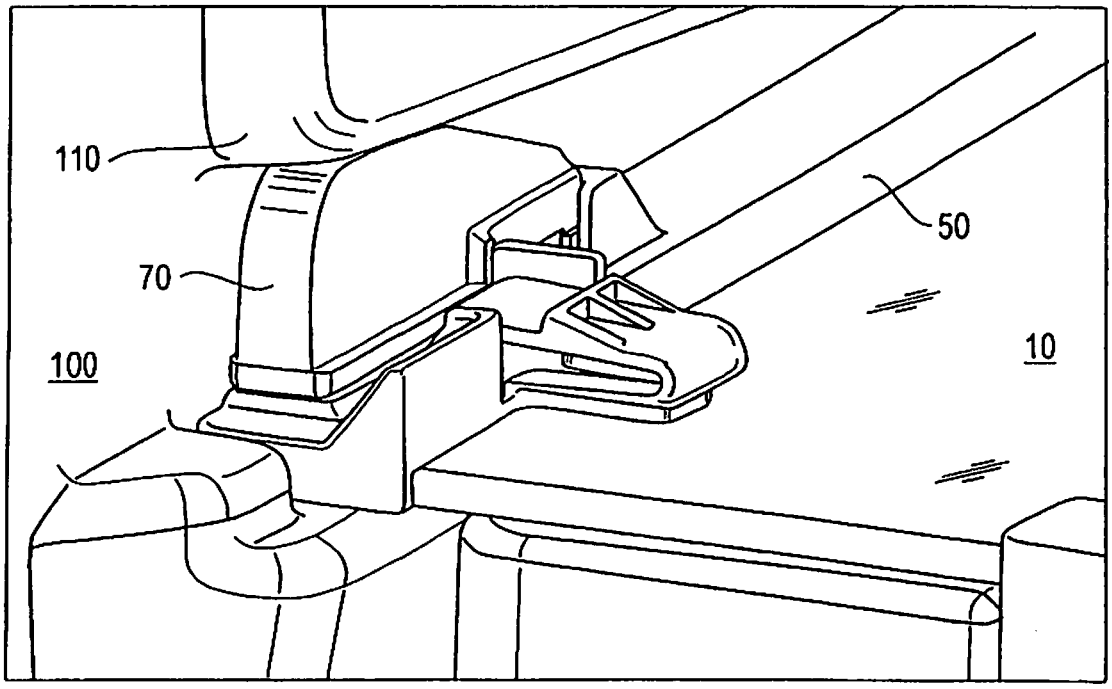
FIG. 7: a securing element to fix a holding rail to the inner container.

A protection against the unauthorized removal of the tray 10 with the icemaker 20 can be seen from FIGS. 6 and 7. In both cases, the tray 10 is secured against the removal from the receiving geometry in the inner container. Provision is preferably made in this respect that the removal of the securing arrangement and thus the removal of the tray 10 is not possible without tools.

FIG. 6 shows an embodiment in which the tray 10 is clamped to a section of the inner container. Provision is made for this purpose that a securing element 60 is inserted whose lower side lies in planar fashion on the tray 10 and which is received in an upper region in a cut-out 120 at the inner container. This securing element 60 is made such that it is pushed laterally into the corresponding cut-out 120 in the inner container 100. The securing element 60 has two regions which are at least partly plate-like and of which one (61) lies on the tray 10 and the other (62) contacts the cut-out. The two plate-like regions 61, 62 extend, for example, in parallel or substantially in parallel with the tray 10. They are connected to one another by a section 63 which extends perpendicular or at an angle to the tray 10 and is directed toward the inner space of the unit.

FIG. 7 shows an embodiment in which a securing element 70 is provided which does not act directly on the tray 10, but rather on the holding rail 50 which is connected to the tray 10. This securing element 70 is pushed in from the front between a rib 100 of the inner container 100 of the freezer and the holding rail 50 and can also be removed toward the front, preferably only while making use of tools.

Figure 8:
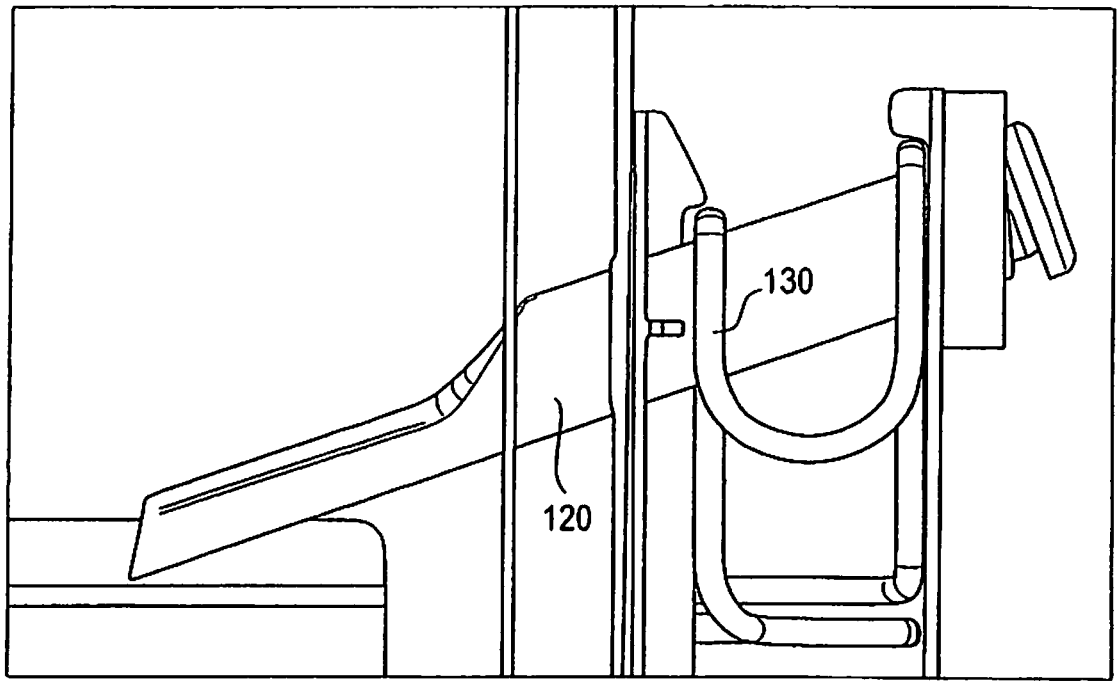
FIG. 8: a view of the water inflow arranged in the rear region of the unit with a heating apparatus.

FIG. 8 finally shows the embodiment of the water inflow 120. As can be seen from FIG. 8, the water inflow 120 takes place through the rear unit wall, that is no connection is necessary to the top or to the intermediate base, whereby new unit variants with different positions of the icemaker are made possible. The component shown in FIG. 8 can be made purely as a water inflow or also a combination part with a cable leadthrough. For the reception of the water inflow 120, a semicircular or partly circular cut-out 12 is provided in the rear region of the tray 10, said cut-out also being visible from FIGS. 1 to 3, with the lugs 22 partly projecting into it.

In the embodiment shown here, the inlet inflow angle is 20° and the material is polypropylene. Other angular embodiments and material embodiments are naturally also conceivable.

A special hook geometry in the middle tube part allows the application of an additional heating 130, as can be seen from FIG. 8.

The present invention enables a selectable space-saving position for the icemaker, for example in the middle region, or also at another position of a freezer. Depending on the requirement, its position can be moved downwardly or upwardly with respect to the variant in accordance with the drawer division.

The freezer can be made with drawers which are not shown in FIG. 5, which run directly on the tray 10, as is in particular the case in accordance with FIG. 2, or which can be pushed in and out via extensible rails which are formed by the holding rails 50 in accordance with FIG. 1 or are connected to them.

The reference symbol 32 in FIGS. 1 and 2 characterizes a nub which is molded to the icemaker 20 and engages into a bore in the tray 10.

The holder of the icemaker can be made as a one-part component with the icemaker and can, for example, form a part of the housing. It is likewise conceivable that the holder and the icemaker are formed by two components which are separate, but which are connected to one another.

The invention claimed is:

1. A tray having an icemaker as well as a holder for fixing the icemaker to the tray, said tray having a rear side wherein the holder is configured and dimensioned such that it engages around the rear side of the tray and fixes the icemaker to a position spaced apart from the rear side of the tray.

2. A tray in accordance with claim 1, wherein the holder fixes the icemaker to the position spaced apart from the rear side of the tray by an adhesive connection, a rivet connection, a weld connection, a shape-matched connection or a screw connection or a shape-matched connection which is realized by a holding part which can be pushed on.

3. A tray in accordance with claim 1, wherein the holder engages around the icemaker and the tray.

4. A tray in accordance with claim 1, wherein the holder is arranged such that it also engages around the tray at its front side.

5. A tray in accordance with claim 1, wherein the holder is fixed to the icemaker by means of a latch connection.

6. A tray in accordance with claim 1, wherein a reed contact for drawer polling is arranged in the holder.

7. A tray in accordance with claim 6, wherein the reed contact has a plug connection by which the reed contact can be connected to an electronics plate.

8. A tray in accordance with claim 1, wherein the holder is made such that the icemaker is arranged directly below the tray.

9. A tray in accordance with claim 1, wherein the tray is made with a cut-out at its rear side for the reception of the water inflow.

10. A tray in accordance with claim 9, wherein the cut-out has a rounded edge and is preferably made as a semicircular portion in the tray.

11. A tray in accordance with claim 1, wherein a cut-out is provided in the tray for the holder wherein said cut-out is a hole for a screw connection of the icemaker.

12. A tray in accordance with claim 1, wherein the tray is made as a glass base.

13. A refrigerator unit and/or a freezer unit having one or more trays in accordance with claim 1 and an inner container.

14. A refrigerator unit and/or a freezer unit in accordance with claim 13, wherein the tray lies directly on a rib of the inner container.

15. A refrigerator unit and/or a freezer unit in accordance with claim 13, wherein the tray is made in its two marginal regions with a holding rail which lies on a rib of the inner container.

16. A refrigerator unit and/or a freezer unit in accordance with claim 15, wherein the unit has at least one drawer which is disposed movable directly on the tray or can be moved in and out by extensible rails, with the extensible rails being connected to the holding rails.

17. A refrigerator unit and/or a freezer unit in accordance with claim 13, wherein at least one securing element is provided which is arranged such that it prevents a removal of the tray from the unit.

18. A refrigerator unit and/or a freezer unit in accordance with claim 17, wherein the securing element is made such that it clamps the tray to the inner container.

19. A refrigerator unit and/or a freezer unit in accordance with claim 18, wherein the securing element is made such that it can be inserted in a lateral direction between the tray and the inner container.

20. A refrigerator unit and/or a freezer unit in accordance with claim 17, wherein the tray is made in its two marginal regions with a holding rail which lies on a support surface, in particular on a rib of the inner container, and the securing element is made such that it clamps the holding rail to the inner container.

21. A refrigerator unit and/or a freezer unit in accordance with claim 20, wherein the securing element is made such that it can be inserted from the front between the inner container and the holding rail.

22. A refrigerator unit and/or a freezer unit in accordance with claim 13, wherein a water inflow is provided for the icemaker which extends through a rear unit wall.

23. A refrigerator unit and/or a freezer unit in accordance with claim 13, wherein the tray can be removed from the unit and can be inserted at different positions in the inner unit space.

24. A refrigerator unit and/or a freezer unit having one or more trays and an inner container, wherein at least one securing element is provided which is arranged such that it prevents a removal of the tray from the unit.

25. A refrigerator unit and/or a freezer unit in accordance with claim 24, wherein the securing element is made such that it clamps the tray to the inner container.

26. A refrigerator unit and/or a freezer unit in accordance with claim 24, wherein the securing element is made such that it can be inserted in the lateral direction between the tray and the inner container.

27. A refrigerator unit and/or a freezer unit in accordance with claim 24, wherein the tray is connected to a holding rail; and the securing element is made such that it clamps the holding rail to the inner container.

28. A refrigerator unit and/or a freezer unit in accordance with claim 27, wherein the securing element is made such that it can be inserted from the front between the inner container and the holding rail.

* * * * *